United States Patent [19]

Preuss

[11] 4,061,086

[45] Dec. 6, 1977

[54] AUXILIARY PILE BOARD ASSEMBLY FOR PRINTING PRESSES

[75] Inventor: Friedrich Preuss, Sprendlingen, Germany

[73] Assignee: Roland Offsetmaschinenfabrik Faber & Schleicher AG., Germany

[21] Appl. No.: 693,683

[22] Filed: June 7, 1976

[30] Foreign Application Priority Data

July 6, 1975 Germany ..... 2525499

[51] Int. Cl.[2] ..... B41F 13/64

[52] U.S. Cl. ..... 101/240; 214/6 DK; 108/54.1

[58] Field of Search ..... 101/238-241; 214/6 DK, 6 H, 8; 108/54.1, 89, 90, 153, 155, 157; 271/223, 220; 312/351

[56] References Cited

U.S. PATENT DOCUMENTS

| | | | |
|---|---|---|---|
| 2,764,377 | 9/1956 | Schoenecker | 108/54.1 |
| 2,828,931 | 4/1958 | Harvey | 108/54.1 |
| 3,410,424 | 11/1968 | Rooney | 214/6 DK |
| 3,587,483 | 6/1971 | Konstant | 108/157 |

FOREIGN PATENT DOCUMENTS

| | | | |
|---|---|---|---|
| 1,163,734 | 2/1964 | Germany | 108/54 |

*Primary Examiner*—Edgar S. Burr

*Assistant Examiner*—A. Heinz

*Attorney, Agent, or Firm*—Leydig, Voit, Osann, Mayer & Holt, Ltd.

[57] ABSTRACT

The invention relates to an auxiliary pile board assembly for use in the temporary support of sheets at the delivery end of a sheet fed printing press and on which sheets are deposited during replacement of the main pile board. The assembly includes a pair of longitudinal rails of equal length spaced parallel to one another with first and second cross rails spanning the space between them. The first cross rail extends perpendicularly between corresponding ends of the longitudinal rails while the second cross rail extends between the longitudinal rails and is adjustably slidable with respect thereto. An auxiliary pile board of limited dimension is interposed between, and supported upon, the cross rails. Manually operated clamps are interposed between the second cross rail and the respective longitudinal rails for clamping the second cross rail in an adjusted position, thereby to permit the assembly to accommodate a number of different pile boards of limited size, proportioned to the size of the sheets being delivered by the press. In the preferred form of the invention the clamping means is in the form of a wedge block which is thrown by a toggle linkage in and out of engagement with a wedging surface.

4 Claims, 7 Drawing Figures

Fig. 1.
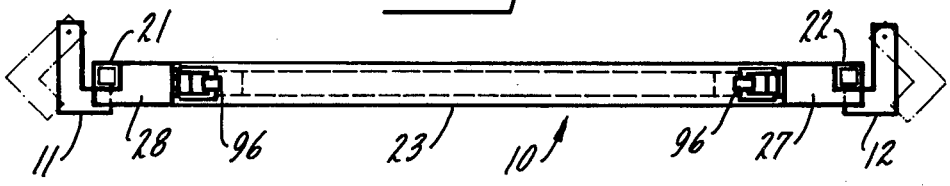
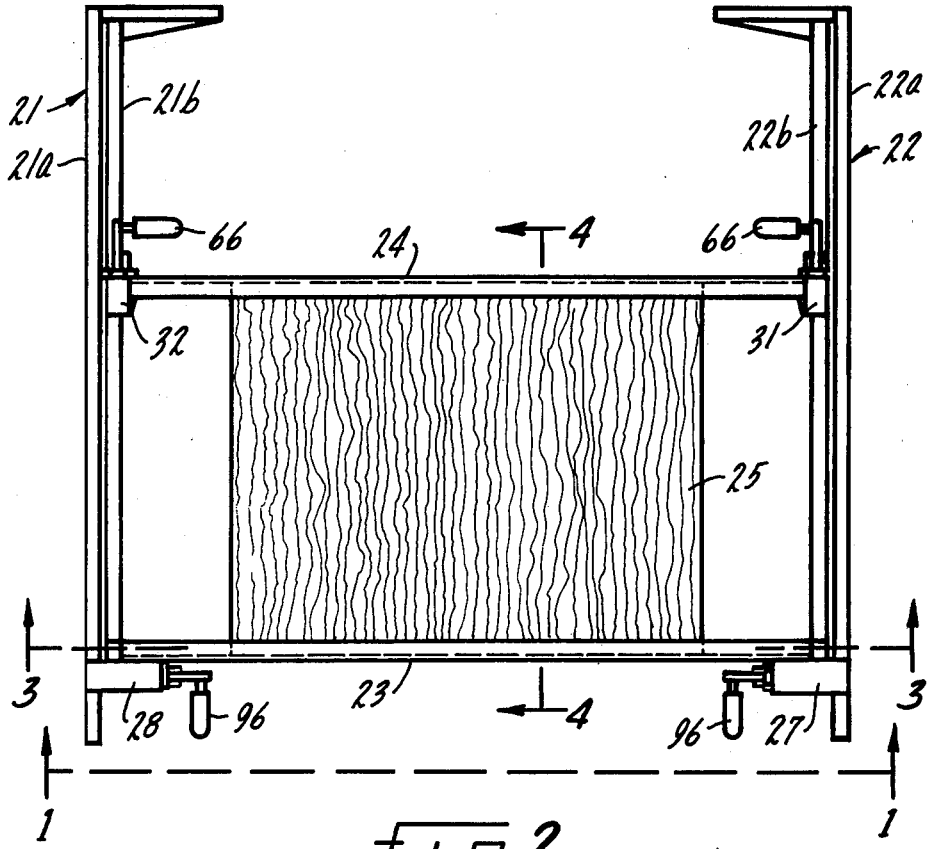
Fig. 2.

AUXILIARY PILE BOARD ASSEMBLY FOR PRINTING PRESSES

In the operation of a sheet fed printing press, printed sheets are deposited upon a pile board. When a stack of sheets has been built up the board is removed with its load and a new board is substituted. However, during the substitution it is necessary to accommodate sheets which continue to flow from the press, and for this purpose an auxiliary pile board is temporarily interposed upon spaced, elevated supports in intercepting position. When a new pile board is in place, the auxiliary board, having served its purpose, is removed.

In the past the dimensions of the auxiliary pile board have been determined by the spacing between the auxiliary supports provided on the press, and the same size of board has been used regardless of the size of the sheets being delivered. This has meant that the auxiliary piles of small sheets have required the same storage area as sheets of maximum size. This is undesirable since conditions in a press room are usually crowded and storage space is at a premium.

It is, accordingly, an object of the invention to provide an auxiliary pile board assembly which is intended to fit the auxiliary supports provided at the delivery end of a printing press but in which the auxiliary pile board itself may be of more limited dimension for use when the press produces printed sheets of small size. It is another object to provide an auxiliary pile board assembly which is capable of accommodating small boards of rectangular profile but having a wide range of dimension for reception of sheets of different sizes down to the smallest size which the press is capable of handling.

Thus it is an object of the invention to provide an auxiliary pile board assembly which is of full size for mounting purposes but which utilizes an auxiliary pile board of a size which is no larger than that required to support the sheets being produced, enabling more convenient and compact storage where space is at a premium together with lightness and ease of handling.

It is a more specific object of the present invention to provide an auxiliary pile board assembly formed of a pair of longitudinal rails spaced to occupy the auxiliary supports normally provided at the delivery end of a press and having first and second cross rails extending between them, at least one of the cross rails being adjustable in its spacing with respect to the other so that a pile board of rectangular shape, but of limited dimension, may be captively interposed between, and supported upon, the cross rails.

It is also a specific object to provide an auxiliary pile board assembly in which pile boards of different size may be easily installed by free sliding movement of a cross bar and locked in place by throwing of a pair of clamps and easily removed by simply reversing the procedure. It is a related object of the present invention to provide an auxiliary pile board assembly which, in spite of the use of a number of parts, is inherently strong and durable and capable of use almost indefinitely under practical press room conditions.

Other objects and advantages of the invention will become apparent upon reading the attached detailed description and upon reference to the drawings in which:

FIG. 1 is a front view of an auxiliary pile board assembly as supported in a press and looking along line 1—1 in FIG. 2.

FIG. 2 is a top view of the pile board assembly shown in FIG. 1.

Figure 6:
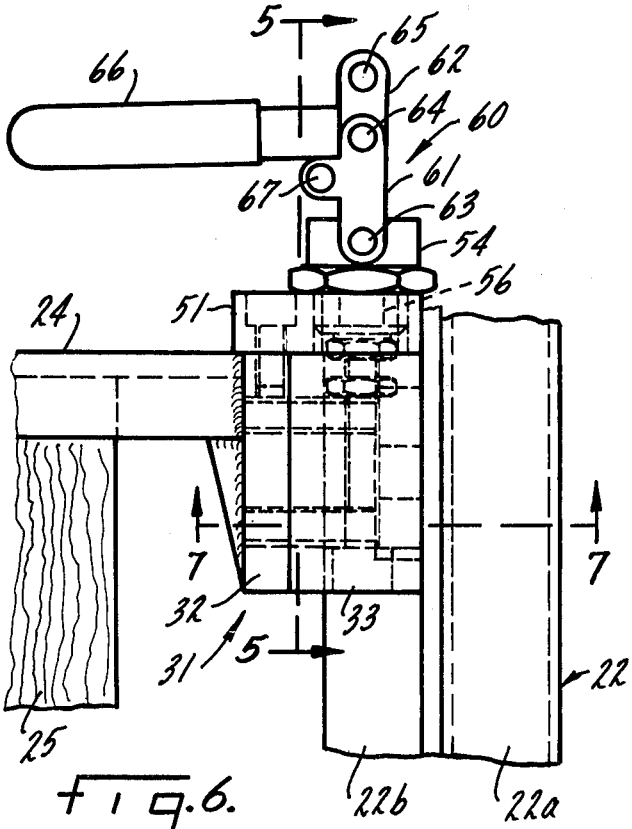
FIG. 6 is an enlarged plan view of one of the clamps with the toggle in dead-center position.
Figure 6A:
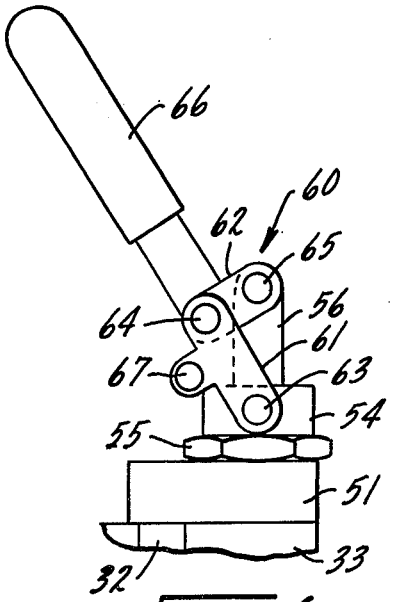

FIG. 6*a* is a fragment based upon FIG. 6 but showing the toggle thrown to released position.

Figure 7:
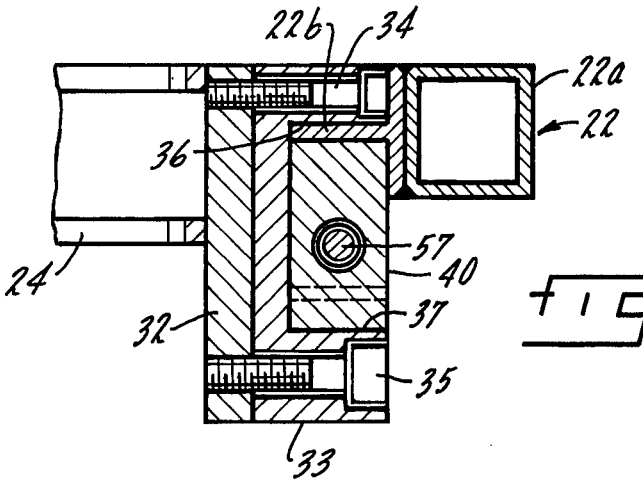

FIG. 7 is a sectional view looking along line 7—7 in FIG. 6.

Figure 8:
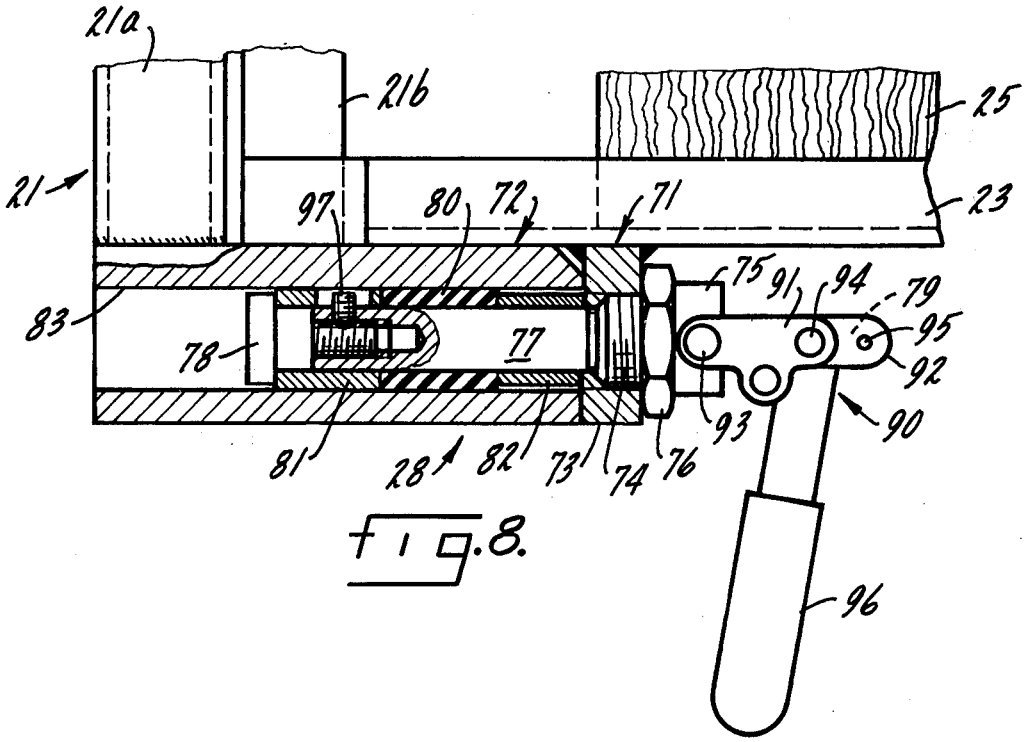

FIG. 8 is a horizontal section taken through a clamp used for securing the relatively fixed cross rail.

While the invention has been shown and described in connection with a preferred embodiment, it will be understood that I do not intend to be limited to the particular embodiment but intend, on the contrary, to cover the various alternative and equivalent forms of the invention included within the spirit and scope of the appended claims.

Turning now to FIGS. 1 and 2 there is shown an auxiliary pile board assembly 10 occupying auxiliary supports 11, 12 provided at the delivery end of a sheet fed printing press, the supports being swingable, for purpose of release, to the dotted positions.

Figure 3:
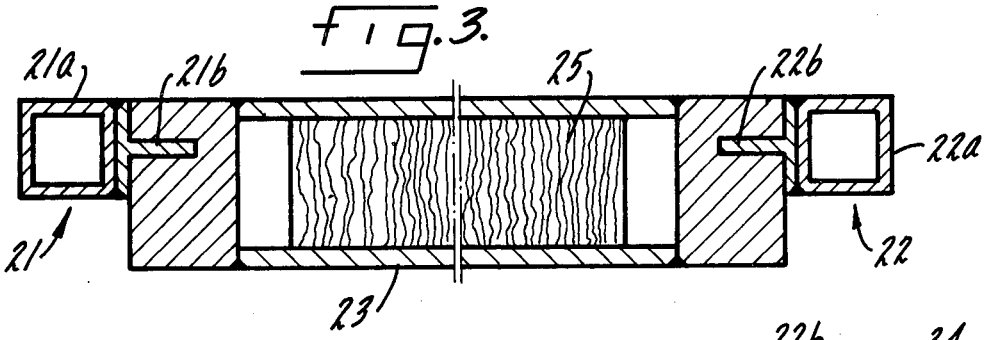
FIG. 3 is an enlarged, but foreshortened, cross section through the assembly looking along line 3—3 in FIG. 2.
Figure 4:
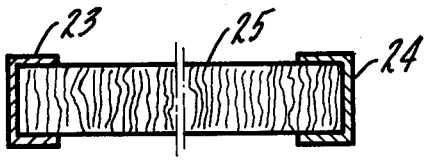
FIG. 4 is a cross section, also foreshortened, taken at right angles thereto along line 4—4 in FIG. 2.

The assembly includes a pair of longitudinal rails 21, 22 of equal length spaced parallel to one another and spanned by first and second cross rails 23, 24 which are also of equal length. The longitudinal rails, as shown in FIG. 3, are of composite construction made up of square tubes **21*a*, 22*a* having, respectively welded thereto, T-shaped way members 21*b*, 22*b*. The cross members 23, 24, as shown in FIG. 4, are of inwardly facing channel shape to accommodate the thickness of an auxiliary pile board 25**. The horizontal flanges formed by the lower ones of the channel walls serve to support the board and its load between the cross members.

The cross member 23, in the preferred embodiment, extends between the ends of the longitudinal rails, being secured thereto by clamps 27, 28, to which reference will later be made in connection with FIG. 8 of the drawings.

In accordance with the present invention the second cross rail 24 extends between the longitudinal rails, engaging the way surfaces on the latter, with manually operated clamps 31, 32 being interposed between the ends of the second cross rail and the respective longitudinal rails for clamping the second cross rail in an adjustably spaced position so that a number of pile boards having different dimensions may be accommodated between the cross rails.

Figure 5:
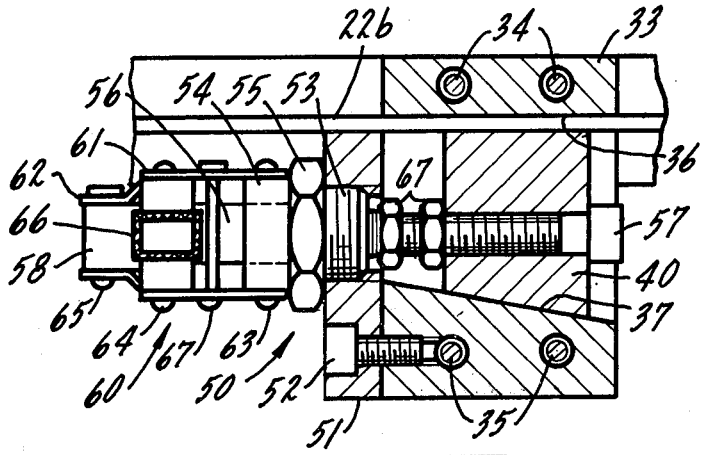
FIG. 5 is a longitudinal section taken through one of the clamps looking along line 5—5 in FIG. 6.

Taking the clamp 31 as representative, and referring to FIGS. 5, 6 and 7, the clamp includes a small rectangular supporting plate 32 to which a slide member 33 is secured by means of machine screws 34, 35. As shown in FIG. 7, the slide member 33 is of "C" or "channel" cross section, with arms presenting a downwardly facing undercut surface 36 and an upwardly facing wedging surface 37 opposed thereto. The surface 36 is horizontal and rides freely upon the way member **22*b***.

The space between the opposed surfaces 36, 37 is occupied by a clamping member in the form of a wedge block 40, the undersurface of which is formed at a shallow wedging angle for mating with the wedging surface 37.

In carrying out the present invention means are provided for moving the wedge blocks between a free position, for slidable adjustment of the cross rail 24 on the way surfaces, and a clamping position in which the cross rail is rigidly fixed in position. Such movement is brought about by means of a toggle assembly 50. The toggle assembly includes a mounting plate 51 secured to the slide member 33 by means of short machine screws 52 (only one of which is shown). Screwed into an aperture formed in the mounting plate 51 is a threaded hollow bushing 53 forming a pedestal 54 having a hexagonal collar 55 which may be engaged by a wrench to screw the bushing firmly into place.

Extending through the hollow bushing 53 is a plunger 56 having an inner end 57 which is secured to the wedge block 40 and an accessible outer end 58.

For moving the plunger longitudinally, a toggle mechanism 60 is provided consisting of a cooperating first link 61 and a second link 62. The first link is pinned at 63 to the pedestal 54. The links are pivoted together by a pin 64 while the upper link is secured by a pin 65 to the outer end 58 of the plunger. For operating the toggle, a handle 66 is provided which is rigidly secured to the second link 62. A stop limits movement of the handle to just slightly over dead-center position (FIG. 6 showing dead center), the limiting means in the present instance being in the form of a transversely extending pin 67 of the first link.

Thus when the toggle is at or near its dead-center position the wedge block 40 is wedged tightly into position shown in FIG. 5, in which position the cross member 24 is securely clamped with respect to way member 22*b*.

To release the clamp the toggle is "broken" by rocking the handle 66 clockwise from the position shown in FIG. 6 to the released position shown in FIG. 6*a*. This moves the wedge block 40 to its "free" position, that is, to the right in FIG. 5.

For the purpose of adjusting the clamp, provision is made for changing the effective length of the plunger 56. This is accomplished by making the plunger of two-piece construction, with the inner end 56 of the plunger being formed of a machine screw which penetrates the wedge block and which is screwed into the outer end portion 58 of the plunger. The screw is maintained in its adjusted position by means of a pair of lock nuts 67. It will be understood that the clamp 32, at the left hand side of FIG. 2, is of the same construction as described, with the parts being arranged in mirror image.

In operation the toggle handles 66 are thrown to their released positions, thereby disengaging the wedge blocks. This permits the second cross rail 24 to be freely retracted along the way surfaces of the longitudinal rails 21, 22. An auxiliary pile board 25, which is of rectangular shape but of limited dimension so as to accommodate a small size of sheet, is inserted into seated position in the cross rail 23, and the cross rail 24 is moved broadwise to hold the auxiliary pile board captive. The handles 66 on the toggles are then returned from the released position shown in FIG. 6*a* to the locked position shown in FIG. 6 which retracts the respective plungers to move the associated wedge blocks 40 into clamping position. This rigidifies the structure, and the assembly may be handled as a tight unit, being slid into place in sheet intercepting position upon the elevated auxiliary supports 11, 12 on the press delivery structure. This permits removal of the main pile board with its load of sheets and substitution of a new pile board. During the transition, the intercepted sheets form a shallow pile on the auxiliary pile board. The latter is then promptly removed so that normal piling may resume.

Upon removal the assembly is placed upon the floor of the press room or on a suitable support, the clamps 31, 32 are released, and the second cross rail 24 is disengaged from the auxiliary pile board so that the latter may be left in a storage position, occupying a much smaller square footage than the full sized auxiliary pile board usually employed.

It will be apparent that the frame of the assembly, made up of the longitudinal rails and cross rails, may be easily adjusted to accommodate a number of different pile boards of limited dimension and with the dimension being proportioned to the size of sheet being delivered. Not only is the storage density maximum, but the small pile boards 25 are lighter and more readily handled than pile boards of conventional size.

If desired, clamps corresponding to the described construction of clamp 31 may be also employed in positions 27, 28. Using longitudinally adjustable clamps in positions 27, 28 permits the pile board 25 to be adjusted in two directions for centered reception of the delivered sheets. However, in the preferred form of the invention the clamps 27, 28 are not of the longitudinally adjustable type but are, instead, of a type permitting a limited amount of lateral adjustment between the cross rail 23 and the longitudinal rail structure.

Thus referring to FIG. 8, the preferred form of clamp is shown in horizontal section, the clamp 28 being taken as representative. The clamp includes a first portion 71 which is welded or otherwise secured to the cross member 23 and a second tubular portion, or socket, 72 which is secured to the end of the associated cross rail 21. The portion 71 includes a mounting plate 73 having an aperture into which is screwed a hollow bushing 74 having a pedestal 75 and a hexagonal collar 76. Extending through the hollow bushing is a plunger 77 having an inner end 78 and an outer end 79.

Surrounding the plunger 77 is a clamping sleeve 80 formed of resilient, rubber like material and two spacer sleeves 81, 82 in end-to-end relation. The clamping sleeve 80 is dimensioned to slide snugly into the hollow 83 of the tubular portion 72 of the clamp which is fixed to the longitudinal rail. When the plunger 77 is retracted the resilient clamping sleeve 80 is squeezed endwise between the sleeves 81, 82, thereby expanding the sleeve 80 radially outward into tight gripping relation with the inner wall of the tube.

For the purpose of moving the plunger 77 between its released position and retracted clamping position, a toggle assembly 90 is provided which is made up of a first toggle link 91 and a second toggle link 92 having pivot pins 93, 94 and 95, the pin 95 engaging the outer end 79 of the plunger. The link 92 has a rigid operating arm 96.

Thus as long as the toggle is in its illustrated dead-center position, the two portions 71, 72 of the clamp are tightly secured to one another so that the cross rail 23 forms a unit with the longitudinal rail 21. A similar construction, in mirror image, is employed for the clamp 27 which secures the cross rail 23 to the longitudinal rail 22. Limited lateral adjustment is provided by the fact that the two portions 71, 72 of the clamp may be either bottomed on one another as illustrated in FIG. 8 or slightly separated from one another in clamped condition, as may be required to insure proper spacing and parallelism between the longitudinal rails 21, 22.

In order to adjust the clamping force, that is, the degree of expansion of the resilient sleeve 80 as the toggle arm is swung into clamping position, the inner end 78 of the plunger 77 may be in the form of an adjusting screw having a large head which bears inwardly against the sleeve 81, with the screw being maintained in adjusted position by means of a set screw 97.

What is claimed is:

1. In an auxiliary pile board assembly for temporary occupation of spaced supports provided at the delivery end of a sheet-fed printing press, the combination comprising a pair of longitudinal rails of substantially equal length spaced parallel to one another for registering with the spaced supports, first and second cross rails of equal length, the first cross rail extending perpendicularly between corresponding ends of the longitudinal rails and secured to the latter, the second cross rail extending between the longitudinal rails parallel to the first cross rail, an auxiliary pile board of limited dimension interposed between and supported upon the cross rails, the longitudinal rails having longitudinally extending way surfaces thereon, the ends of the second cross rail being slidable on the way surfaces for purposes of lateral adjustment, the ends of the second cross rail having respective clamping members for applying pressure against the way surfaces, and means for tightening such members against the way surfaces for immobilizing the second cross rail in adjusted position with respect to the first cross rail for individual accommodation of a number of different pile boards of limited dimension proportioned to the size of the sheets being delivered by the press.

2. The combination as claimed in claim 1 in which the tightening means is in the form of toggles manually movable for drawing the clamping members progressively into engagement with the way surfaces.

3. The combination as claimed in claim 1 in which the clamping members include wedge blocks each having an adjacent wedging surface, and means including a linkage for drawing the wedge blocks relatively into engagement with the wedging surfaces.

4. The combination as claimed in claim 1 in which the cross rails are formed of channels facing mutually inward for captively embracing opposite edges of the auxiliary pile board.

* * * * *